US009140082B2

(12) United States Patent
Lajesic

(10) Patent No.: US 9,140,082 B2
(45) Date of Patent: Sep. 22, 2015

(54) ADJUSTABLE BULLNOSE ASSEMBLY FOR USE WITH A WELLBORE DEFLECTOR ASSEMBLY

(71) Applicant: Halliburton Energy Services, Inc., Houston, TX (US)

(72) Inventor: Borisa Lajesic, Addison, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/358,900

(22) PCT Filed: Jul. 25, 2013

(86) PCT No.: PCT/US2013/052080
§ 371 (c)(1),
(2) Date: May 16, 2014

(87) PCT Pub. No.: WO2015/012844
PCT Pub. Date: Jan. 29, 2015

(65) Prior Publication Data

US 2015/0184474 A1 Jul. 2, 2015

(51) Int. Cl.
*E21B 17/18* (2006.01)
*E21B 23/12* (2006.01)
*E21B 41/00* (2006.01)

(52) U.S. Cl.
CPC ..... *E21B 23/002* (2013.01); *E21B 17/18* (2013.01); *E21B 41/0035* (2013.01)

(58) Field of Classification Search
USPC ..... 166/381, 241.1
See application file for complete search history.

(56) References Cited

U.S. PATENT DOCUMENTS

| | | | | |
|---|---|---|---|---|
| 3,866,628 | A | 2/1975 | Weber et al. | |
| 4,570,673 | A * | 2/1986 | Kendrick et al. | 137/615 |
| 5,526,880 | A | 6/1996 | Jordan, Jr. et al. | |
| 6,089,320 | A | 7/2000 | LaGrange | |
| 6,311,776 | B1 | 11/2001 | Pringle et al. | |
| 6,527,067 | B1 * | 3/2003 | Ravensbergen et al. | 175/381 |
| 2012/0305266 | A1 | 12/2012 | Steele et al. | |
| 2012/0305268 | A1 | 12/2012 | Steele | |

FOREIGN PATENT DOCUMENTS

WO 2015012844 A1 1/2015

OTHER PUBLICATIONS

International Search Report and Written Opinion for PCT/US 2013/052080 dated Apr. 25, 2014.

* cited by examiner

*Primary Examiner* — Taras P Bemko
(74) *Attorney, Agent, or Firm* — McDermott Will & Emery LLP; Alan Bryson

(57) ABSTRACT

A wellbore system includes an upper deflector arranged within a main bore and defines first and second channels that extend longitudinally therethrough. A lower deflector is arranged within the main bore and spaced from the upper deflector by a predetermined distance. The lower deflector defines a first conduit that communicates with a lower portion of the main bore and a second conduit that communicates with a lateral bore. A bullnose assembly includes a body, a bullnose tip arranged at a distal end of the body, and a sleeve member arranged about the body. The sleeve member or the bullnose tip is axially movable to vary a length of the bullnose tip, and the upper and lower deflectors direct the bullnose assembly into the lateral bore or the lower portion of the main bore based on the length of the bullnose tip.

21 Claims, 7 Drawing Sheets

ADJUSTABLE BULLNOSE ASSEMBLY FOR USE WITH A WELLBORE DEFLECTOR ASSEMBLY

BACKGROUND

The present disclosure relates generally to multilateral wellbores and, more particularly, to an adjustable bullnose assembly that works with a deflector assembly to allow entry into more than one lateral wellbore of a multilateral wellbore.

Hydrocarbons can be produced through relatively complex wellbores traversing a subterranean formation. Some wellbores include one or more lateral wellbores that extend at an angle from a parent or main wellbore. Such wellbores are commonly called multilateral wellbores. Various devices and downhole tools can be installed in a multilateral wellbore in order to direct assemblies toward a particular lateral wellbore. A deflector, for example, is a device that can be positioned in the main wellbore at a junction and configured to direct a bullnose assembly conveyed downhole toward a lateral wellbore. Depending on various parameters of the bullnose assembly, some deflectors also allow the bullnose assembly to remain within the main wellbore and otherwise bypass the junction without being directed into the lateral wellbore.

Accurately directing the bullnose assembly into the main wellbore or the lateral wellbore can often be a difficult undertaking. For instance, accurate selection between wellbores commonly requires that both the deflector and the bullnose assembly be correctly oriented. Moreover, conventional bullnose assemblies are typically only able to enter a lateral wellbore at a junction where the design parameters of the deflector correspond to the design parameters of the bullnose assembly. In order to enter another lateral wellbore at a junction having a differently designed deflector, the bullnose assembly must be returned to the surface and replaced with a bullnose assembly exhibiting design parameters corresponding to the differently designed deflector. This process can be time consuming and costly.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates generally to multilateral wellbores and, more particularly, to an adjustable bullnose assembly that works with a deflector assembly to allow entry into more than one lateral wellbore of a multilateral wellbore.

The present disclosure describes embodiments of an exemplary bullnose assembly that is able to adjust its length while downhole in a multilateral wellbore. This may prove advantageous for well operators since the variable length bullnose assembly may be able to be conveyed downhole and bypass one or more deflector assemblies until reaching a desired deflector assembly. At the desired deflector assembly, the variable length bullnose assembly may be actuated to alter its length such that it may be deflected by the deflector assembly into a desired lateral wellbore. Such length variability in the bullnose assembly may allow a single bullnose assembly to enter several different lateral boreholes in a stacked multilateral well having several junctions all in one trip downhole.

Figure 1:
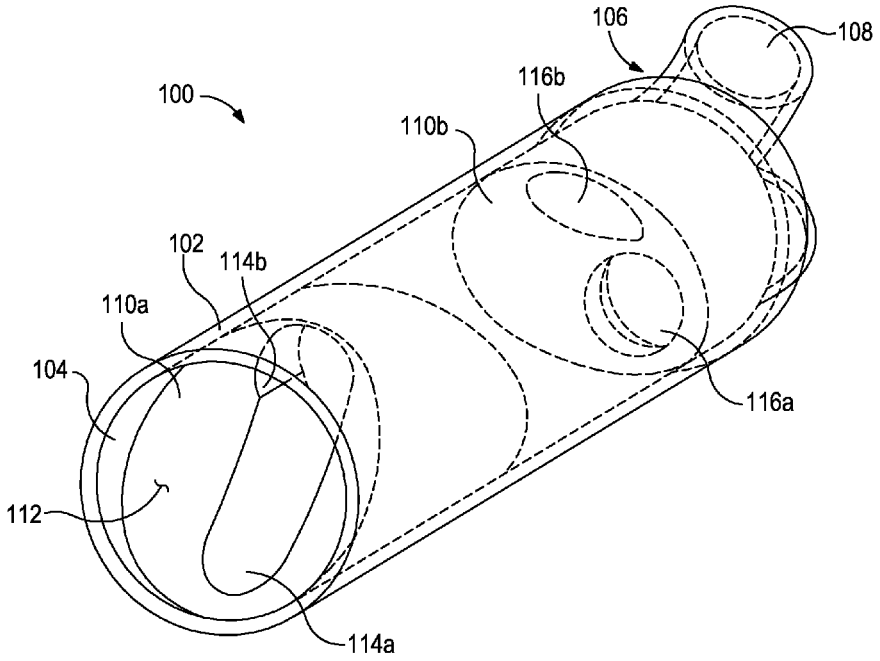
FIG. 1 depicts an isometric view of an exemplary deflector assembly, according to one or more embodiments of the disclosure.
Figure 2:
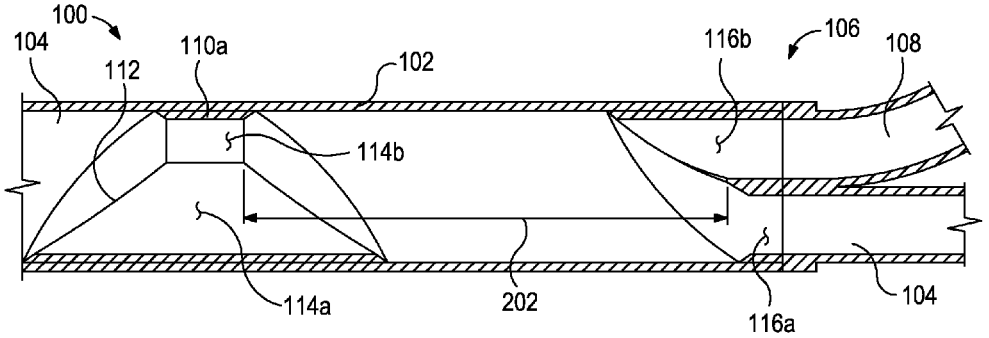
FIG. 2 depicts a cross-sectional side view of the deflector assembly of FIG. 1.

Referring to FIGS. 1 and 2, illustrated are isometric and cross-sectional side views, respectively, of an exemplary deflector assembly 100, according to one or more embodiments of the disclosure. As illustrated, the deflector assembly 100 may be arranged within or otherwise form an integral part of a tubular string 102. In some embodiments, the tubular string 102 may be a casing string used to line the inner wall of a wellbore drilled into a subterranean formation. In other embodiments, the tubular string 102 may be a work string extended downhole within the wellbore or the casing that lines the wellbore. In either case, the deflector assembly 100 may be generally arranged within a parent or main bore 104 at or otherwise uphole from a junction 106 where a lateral bore 108 extends from the main bore 104. The lateral bore 108 may extend into a lateral wellbore (not shown) drilled at an angle away from the parent or main bore 104.

The deflector assembly 100 may include a first or upper deflector 110*a* and a second or lower deflector 110*b*. In some embodiments, the upper and lower deflectors 110*a,b* may be secured within the tubular string 102 using one or more mechanical fasteners (not shown) and the like. In other embodiments, the upper and lower deflectors 110*a,b* may be welded into place within the tubular string 102, without departing from the scope of the disclosure. In yet other embodiments, the upper and lower deflectors 110*a,b* may form an integral part of the tubular string 102, such as being machined out of bar stock and threaded into the tubular string 102. The upper deflector 110*a* may be arranged closer to the surface (not shown) than the lower deflector 110*b*, and the lower deflector 110 may be generally arranged at or adjacent the junction 106.

The upper deflector 110*a* may define or otherwise provide a ramped surface 112 facing toward the uphole direction within the main bore 104. The upper deflector 110*a* may further define a first channel 114*a* and a second channel 114*b*, where both the first and second channels 114*a,b* extend longitudinally through the upper deflector 110*a*. The lower deflector 110*b* may define a first conduit 116*a* and a second conduit 116*b*, where both the first and second conduits 116*a,b* extend longitudinally through the lower deflector 110*b*. The second conduit 116*b* extends into and otherwise feeds the lateral bore 108 while the first conduit 116*a* continues downhole and is otherwise configured to extend the parent or main bore 104 past the junction 106. Accordingly, in at least one embodiment, the deflector assembly 100 may be arranged in a multilateral wellbore system where the lateral bore 108 is only one of several lateral bores that are accessible from the main bore 104 via a corresponding number of deflector assemblies 100 arranged at multiple junctions.

The deflector assembly 100 may be useful in directing a bullnose assembly (not shown) into the lateral bore 108 via the second conduit 116*b* based on a length of the bullnose assembly. If the length of the bullnose assembly does not meet particular length requirements or parameters, it will instead be directed further downhole in the main bore 104 via the first conduit 116*a*. For example, with reference to FIG. 2, the first deflector 110*a* may be separated from the second deflector 110*b* within the main bore 104 by a distance 202. The distance 202 may be a predetermined distance that allows a bullnose assembly that is as long as or longer than the distance 202 to be directed into the lateral bore 108 via the second conduit 116*b*. If the length of the bullnose assembly is shorter than the distance 202, however, the bullnose assembly will remain in the main bore 104 and be directed further downhole via the first conduit 116*a*.

Figure 3A:
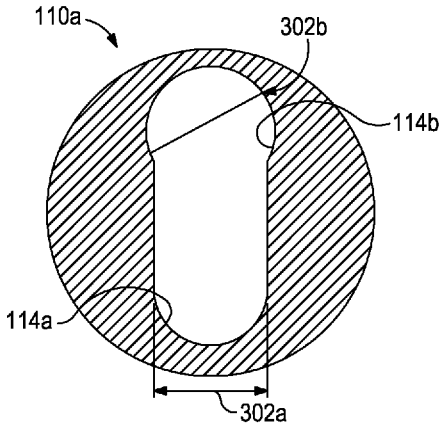
FIGS. 3A and 3B illustrate cross-sectional end views of upper and lower deflectors, respectively, of the deflector assembly of FIG. 1, according to one or more embodiments.
Figure 3B:
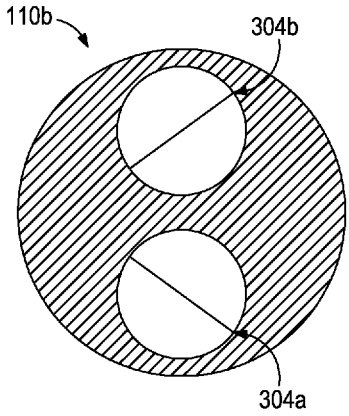

Referring now to FIGS. 3A and 3B, with continued reference to FIGS. 1 and 2, illustrated are cross-sectional end views of the upper and lower deflectors 110*a,b*, respectively, according to one or more embodiments. In FIG. 3A, the first channel 114*a* and the second channel 114*b* are shown as extending longitudinally through the upper deflector 110*a*. The first channel 114*a* may exhibit a first width 302*a* and the second channel 114*b* may exhibit a second width 302*b*, where the second width 302*b* is also equivalent to a diameter of the second channel 114*b*.

As depicted, the first width 302*a* is less than the second width 302*b*. As a result, bullnose assemblies exhibiting a diameter larger than the first width 302*a* but smaller than the second width 302*b* may be able to extend through the upper deflector 110*a* via the second channel 114*b* and otherwise bypass the first channel 114*a*. Alternatively, bullnose assemblies exhibiting a diameter smaller than the first width 302*a* may be able to pass through the upper deflector 110*a* via the first or second channels 114*a,b*.

In FIG. 3B, the first and second conduits 116*a,b* are shown as extending longitudinally through the lower deflector 110*b*. The first conduit 116*a* may exhibit a first diameter 304*a* and the second conduit 116*b* may exhibit a second diameter 304*b*. In some embodiments, the first and second diameters 304*a,b* may be the same or substantially the same. In other embodiments, the first and second diameters 304*a,b* may be different. In either case, the first and second diameters 304*a,b* may be large enough and otherwise configured to receive a bullnose assembly therethrough after the bullnose assembly has passed through the upper deflector 110*a* (FIG. 3A).

Figure 4A:
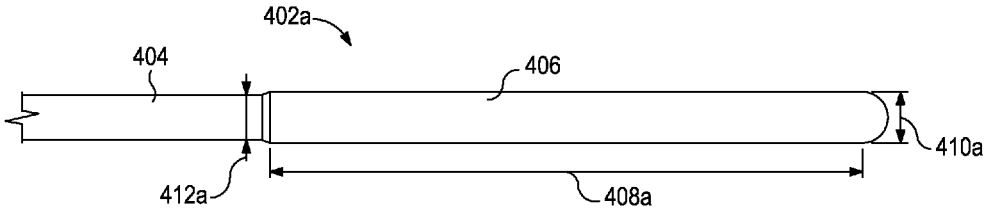
FIGS. 4A and 4B depict exemplary first and second bullnose assemblies, respectively, according to one or more embodiments.
Figure 4B:
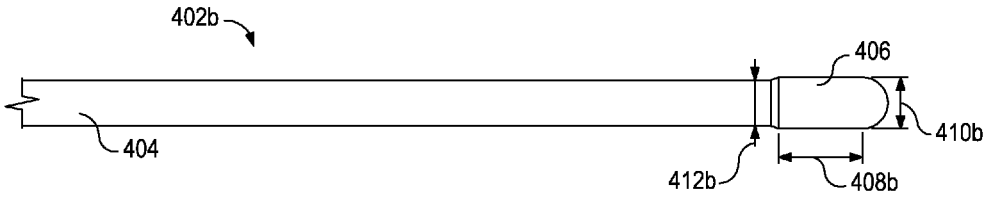

Referring now to FIGS. 4A and 4B, illustrated are exemplary first and second bullnose assemblies 402*a* and 402*b*, respectively, according to one or more embodiments. The bullnose assemblies 402*a,b* may constitute the distal end of a tool string (not shown), such as a bottom hole assembly or the like, that is conveyed downhole within the main wellbore 104 (FIGS. 1-2) from a well surface (not shown). In some embodiments, the bullnose assemblies 402*a,b* and related tool strings are conveyed downhole using coiled tubing (not shown). In other embodiments, however, the bullnose assemblies 402*a,b* and related tool strings may be conveyed downhole using other types of conveyances such as, but not limited to, drill pipe, production tubulars, or any conduit capable of conveying fluid pressure. In yet other embodiments, the bullnose assemblies 402*a,b* and related tool strings may be conveyed downhole using wireline, slickline, electric line, etc, without departing from the scope of the disclosure. The tool string may include various downhole tools and devices configured to perform or otherwise undertake various wellbore operations once accurately placed in the downhole environment. The bullnose assemblies 402*a,b* may be configured to accurately guide the tool string downhole such that it reaches its target destination, e.g., the lateral bore 108 of FIGS. 1-2 or further downhole within the main bore 104.

To accomplish this, each bullnose assembly 402*a,b* may include a body 404 and a bullnose tip 406 coupled or otherwise attached to the distal end of the body 404. In some embodiments, the bullnose tip 406 may form an integral part of the body 404 as an integral extension thereof. As illustrated, the bullnose tip 406 may be rounded off at its end or otherwise angled or arcuate such that the bullnose tip 406 does not present sharp corners or angled edges that might catch on portions of the main bore 104 as it is extended downhole.

The bullnose tip 406 of the first bullnose assembly 402*a* exhibits a first length 408*a* and the bullnose tip 406 of the second bullnose assembly 402*b* exhibits a second length 408*b*. As depicted, the first length 408*a* is greater than the second length 408*b*. Moreover, the bullnose tip 406 of the first bullnose assembly 402*a* exhibits a first diameter 410*a* and the bullnose tip 406 of the second bullnose assembly 402*b* exhibits a second diameter 410*b*. In some embodiments, the first and second diameters 410*a,b* may be the same or substantially the same. In other embodiments, the first and second diameters 410*a,b* may be different. In either case, the first and second diameters 410*a,b* may be small enough and otherwise able to extend through the second width 302*b* (FIG. 3A) of the upper deflector 110*a* and the first and second diameters 304*a,b* (FIG. 3B) of the lower deflector 110*b*.

Still referring to FIGS. 4A and 4B, the body 404 of the first bullnose assembly 402*a* exhibits a third diameter 412*a* and the body 404 of the second bullnose assembly 402*b* exhibits a fourth diameter 412*b*. In some embodiments, the third and fourth diameters 412*a,b* may be the same or substantially the same. In other embodiments, the third and fourth diameters 412*a,b* may be different. In either case, the third and fourth diameters 412*a,b* may each be smaller than the first and second diameters 410*a,b*. Moreover, the third and fourth diameters 412*a,b* may be smaller than the first width 302*a* (FIG. 3A) of the upper deflector 110*a* and otherwise able to be received therein, as will be discussed in greater detail below.

Figure 5A:
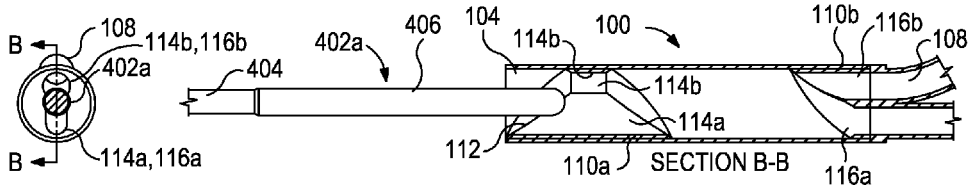
FIGS. 5A-5C illustrate cross-sectional progressive views of the deflector assembly of FIGS. 1 and 2 in exemplary operation with the bullnose assembly of FIG. 4A, according to one or more embodiments.
Figure 5B:
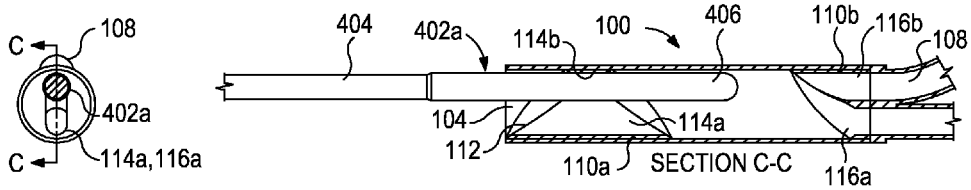
Figure 5C:
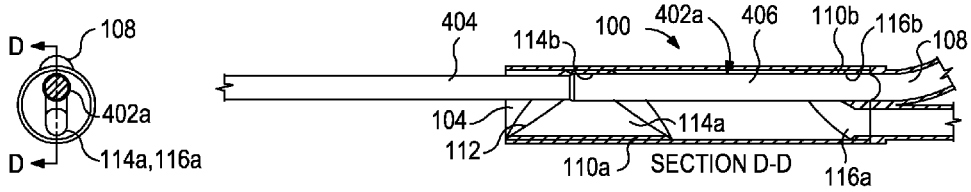

Referring now to FIGS. 5A-5C, with continued reference to the preceding figures, illustrated are cross-sectional views of the deflector assembly 100 as used in exemplary operation, according to one or more embodiments. More particularly, FIGS. 5A-5C illustrate progressive views of the first bullnose assembly 402*a* of FIG. 4A interacting with and otherwise being deflected by the deflector assembly 100 based on the parameters of the first bullnose assembly 402*a*. Furthermore, each of FIGS. 5A-5C provides a cross-sectional end view (on the left of each figure) and a corresponding cross-sectional side view (on the right of each figure) of the exemplary operation as it progresses.

In FIG. 5A, the first bullnose assembly 402*a* is extended downhole within the main bore 104 and engages the upper deflector 110*a*. More specifically, the diameter 410*a* (FIG. 4A) of the bullnose tip 406 may be larger than the first width 302*a* (FIG. 3A) such that the bullnose tip 406 is unable to extend through the upper deflector 110*a* via the first channel 114*a*. Instead, the bullnose tip 406 may be configured to slidingly engage the ramped surface 112 until locating the second channel 114*b*. Since the diameter 410*a* (FIG. 4A) of the bullnose tip 406 is smaller than the second width 302*b* (FIG. 3A), the bullnose assembly 402*a* is able to extend through the upper deflector 110*a* via the second channel 114*b*. This is shown in FIG. 5B as the bullnose assembly 402*a* is advanced in the main bore 104 and otherwise extended at least partially through the upper deflector 110*a*.

In FIG. 5C, the bullnose assembly 402*a* is advanced further in the main bore 104 and directed into the second conduit 116*b* of the lower deflector 110*b*. This is possible since the length 408*a* (FIG. 4A) of the bullnose tip 406 is greater than the distance 202 (FIG. 2) that separates the upper and lower deflectors 110*a,b*. In other words, since the distance 202 is less than the length 408*a* of the bullnose tip 406, the bullnose assembly 402*a* is generally prevented from moving laterally within the main bore 104 and toward the first conduit 116*a* of the lower deflector 110*b*. Rather, the bullnose tip 406 is received by the second conduit 116*b* while at least a portion of the bullnose tip 406 remains supported in the second channel 114*b* of the upper deflector 110*a*. Moreover, the second conduit 116*b* exhibits a diameter 304*b* (FIG. 3B) that is greater than the diameter 410*a* (FIG. 4A) of the bullnose tip 406 and can therefore guide the bullnose assembly 402*a* toward the lateral bore 108.

Referring now to FIGS. 6A-6D, with continued reference to the preceding figures, illustrated are cross-sectional views of the deflector assembly 100 as used in exemplary operation, according to one or more embodiments. More particularly, FIGS. 6A-6D illustrate progressive views of the second bullnose assembly 402*b* interacting with and otherwise being deflected by the deflector assembly 100. Furthermore, similar to FIGS. 5A-5C, each of FIGS. 6A-6D provides a cross-sectional end view (on the left of each figure) and a corresponding cross-sectional side view (on the right of each figure) of the exemplary operation as it progresses.

Figure 6A:
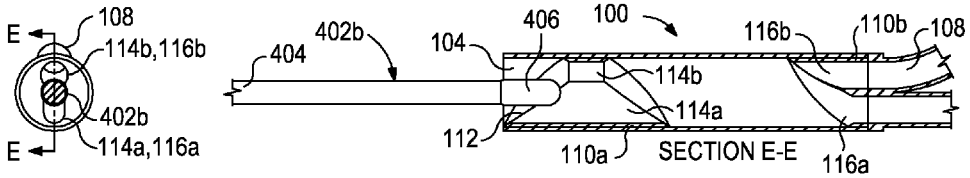
FIGS. 6A-6D illustrate cross-sectional progressive views of the deflector assembly of FIGS. 1 and 2 in exemplary operation with the bullnose assembly of FIG. 4B, according to one or more embodiments.
Figure 6B:
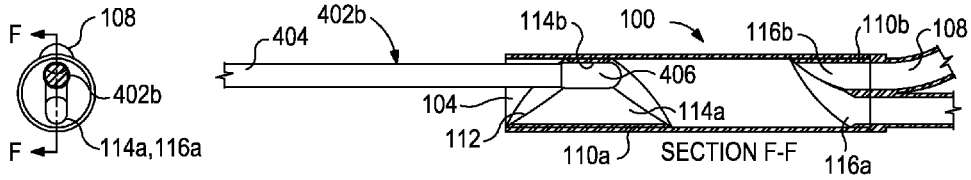

In FIG. 6A, the second bullnose assembly 402*b* is shown engaging the upper deflector 110*a* after having been extended downhole within the main bore 104. More specifically, and similar to the first bullnose assembly 402*a*, the diameter 410*b* (FIG. 4B) of the bullnose tip 406 may be larger than the first width 302*a* (FIG. 3A) such that the bullnose tip 406 is unable to extend through the upper deflector 110*a* via the first channel 114*a*. Instead, the bullnose tip 406 may be configured to slidingly engage the ramped surface 112 until locating the second channel 114*b*. Since the diameter 410*b* (FIG. 4B) of the bullnose tip 406 is smaller than the second width 302*b* (FIG. 3A), the bullnose assembly 402*b* may be able to extend through the upper deflector 110*a* via the second channel 114*b*. This is shown in FIG. 6B as the bullnose assembly 402*b* is advanced in the main bore 104 and otherwise extended at least partially through the upper deflector 110*a*.

Figure 6C:
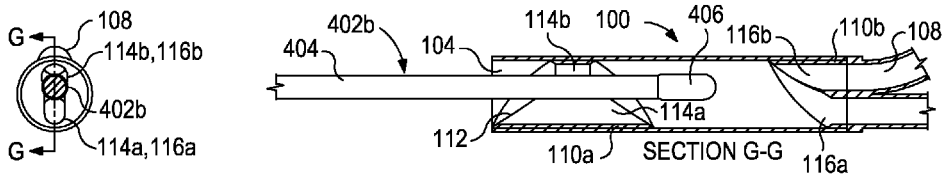

In FIG. 6C, the bullnose assembly 402*b* is advanced further in the main bore 104 until the bullnose tip 406 exits the second channel 114*b*. Upon the exit of the bullnose tip 406 from the second channel 114*b*, the bullnose assembly 402*b* may no longer be supported within the second channel 114*b* and may instead fall into or otherwise be received by the first channel 114*a*. This is possible since the diameter 412*b* (FIG. 4B) of the body 404 of the bullnose assembly 402*b* is smaller than the first width 302*a* (FIG. 3A), and the length 408*b* (FIG. 4B) of the bullnose tip 406 is less than the distance 202 (FIG. 2) that separates the upper and lower deflectors 110*a,b*. Accordingly, gravity may act on the bullnose assembly 402*b* and allow it to fall into the first channel 114*a* once the bullnose tip 406 exits the second channel 114*b* and no longer supports the bullnose assembly 402*b*.

Figure 6D:
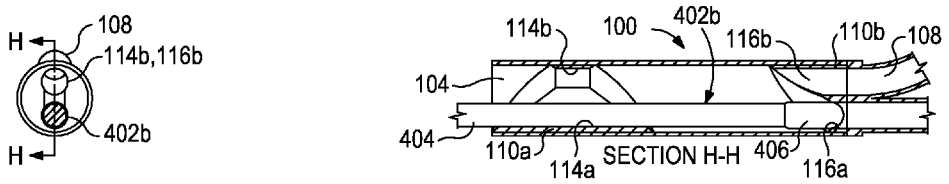

In FIG. 6D, the bullnose assembly 402*b* is advanced even further in the main bore 104 until the bullnose tip 406 enters or is otherwise received within the first conduit 116*a*. The first conduit 116*a* exhibits a diameter 304*a* (FIG. 3B) that is greater than the diameter 410*b* (FIG. 4B) of the bullnose tip 406 and can therefore guide the bullnose assembly 402*b* further down the main bore 104 and otherwise not into the lateral bore 108.

Accordingly, which bore (e.g., the main bore 104 or the lateral bore 108) a bullnose assembly enters is primarily determined by the relationship between the length 408*a,b* of the bullnose tip 406 and the distance 202 between the upper and lower deflectors 110*a,b*. As a result, it becomes possible to "stack" multiple junctions 106 (FIGS. 1 and 2) having the same deflector assembly 100 design in a single multilateral well and entering respective lateral bores 108 at each junction 106 with a single, variable-length bullnose assembly, all in a single trip into the well.

Figure 7:
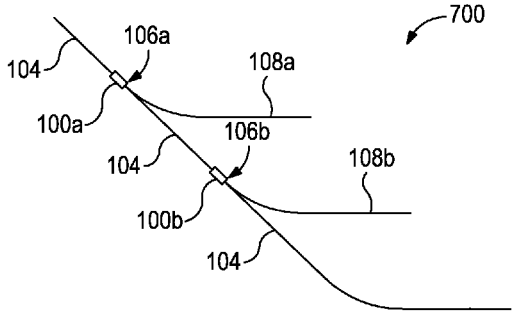
FIG. 7 illustrates an exemplary multilateral wellbore system that may implement the principles of the present disclosure.

Referring to FIG. 7, with continued reference to FIGS. 1 and 2, illustrated is an exemplary multilateral wellbore system 700 that may implement the principles of the present disclosure. The wellbore system 700 may include a main bore 104 that extends from a surface location (not shown) and passes through at least two junctions 106 (shown as a first junction 106*a* and a second junction 106*b*). While two junctions 106*a,b* are shown in the wellbore system 700, it will be appreciated that more than two junctions 106*a,b* may be utilized, without departing from the scope of the disclosure.

At each junction 106*a,b*, a lateral bore 108 (shown as first and second lateral bores 108*a* and 108*b*, respectively) extends from the main bore 104. Similar designs of the deflector assembly 100 of FIGS. 1 and 2 may be arranged at each junction 106*a,b*, shown in FIG. 7 as a first deflector assembly 100*a* and a second deflector assembly 100*b*. Accordingly, each junction 106*a,b* includes a deflector assembly 100*a,b* having upper and lower deflectors 110*a,b* that are spaced from each other by the same distance 202 (FIG. 2). In such an embodiment, a bullnose assembly that is able to vary its length may be used to enter the first and second lateral bores 108*a,b* by adjusting its length so as to be longer than the distance 202 at the desired junction 106*a,b*, and thereby be deflected into the respective second conduits 116*b* (FIGS. 1 and 2) of the particular deflector assembly 100*a,b*.

Figure 8A:
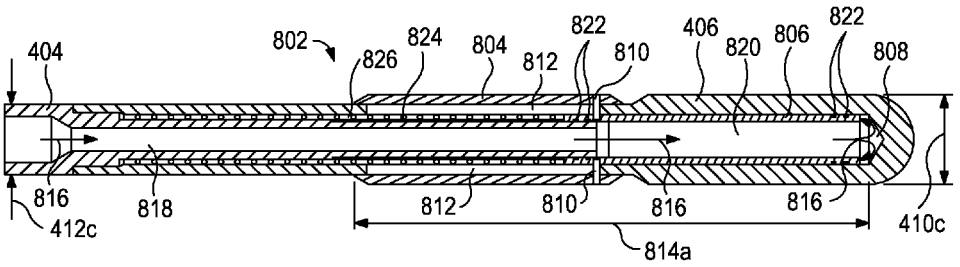
FIGS. 8A and 8B illustrate cross-sectional side views of an exemplary bullnose assembly, according to one or more embodiments.
Figure 8B:
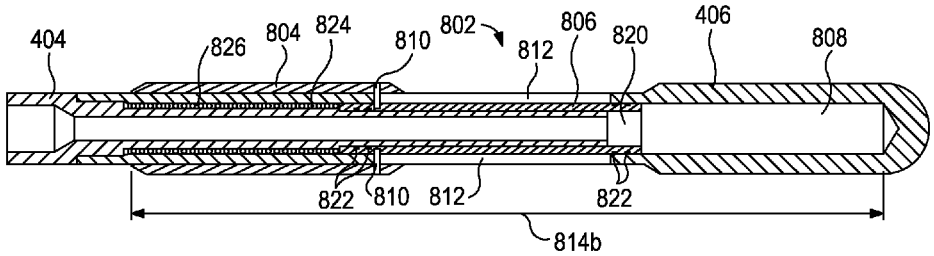

Referring to FIGS. 8A and 8B, illustrated are cross-sectional side views of an exemplary bullnose assembly 802 capable of adjusting its length, according to one or more embodiments. The bullnose assembly 802 may be similar in some respects to the bullnose assemblies 402*a,b* of FIGS. 4A and 4B and therefore will be best understood with reference thereto, where like numerals represent like elements not described again in detail.

Similar to the bullnose assemblies 402*a,b* of FIGS. 4A and 4B, the bullnose assembly 802 includes a body 404 and a bullnose tip 406 coupled to the distal end of the body 404 or otherwise forming an integral part thereof. Moreover, the bullnose tip 406 of the bullnose assembly 802 exhibits a fifth diameter 410*c* that may be the same as or different than the first and second diameters 410*a,b* (FIGS. 4A and 4B). In any event, the fifth diameter 410*c* may be small enough and otherwise able to extend through the second width 302*b* (FIG. 3A) of the upper deflector 110*a* and the first and second diameters 304*a,b* (FIG. 3B) of the lower deflector 110*b* of either the first or second deflector assemblies 100*a,b*.

The body 404 of the bullnose assembly 802 exhibits a sixth diameter 412*c* that may be the same as or different than the third and fourth diameters 412*a,b* (FIGS. 4A and 4B). In any event, the sixth diameter 412*c* may be smaller than the first, second, and third diameters 410*a-c* and also smaller than the first width 302*a* (FIG. 3A) of the upper deflector 110*a* of the first and second deflector assemblies 100*a,b*, and otherwise able to be received therein.

The bullnose assembly 802 may further include a sleeve member 804 arranged about a portion of at least one of the body 404 and the bullnose tip 406. The sleeve member 804 may be sized such that it exhibits the fifth diameter 410*c*. Accordingly, the sleeve member 804 and the bullnose tip 406 may exhibit the same diameter 410*c*. Upon being actuated, as described below, the sleeve member 804 may be configured to move axially with respect to the bullnose tip 406, and thereby effectively alter the overall length of the bullnose tip 406. As will be discussed below, however, in some embodiments, the sleeve member 804 may be a stationary part of the bullnose assembly 802 and the bullnose tip 406 may axially move with respect to the sleeve member 804 in order to adjust the length of the bullnose tip 406, without departing from the scope of the disclosure.

As used herein, the phrase "length of the bullnose tip 406" refers to the axial length of the bullnose assembly 802 that encompasses the axial length of both the bullnose tip 406 and the sleeve member 804. When the sleeve member 804 is arranged distally from the bullnose tip 406, as described below, the "length of the bullnose tip 406" further refers to the axial lengths of both the bullnose tip 406 and the sleeve member 804 and any distance that separates the two components.

A piston 806 may be movably arranged within a hydraulic chamber 808 defined within the bullnose tip 406. The piston 806 may be operatively coupled to the sleeve member 804 such that movement of the piston 806 correspondingly moves the sleeve member 804. In the illustrated embodiment, one or more coupling pins 810 (two shown) may operatively couple the piston 806 to the sleeve member 804. More particularly, the coupling pins 810 may extend between the piston 806 and the sleeve member 804 through corresponding longitudinal grooves 812 defined in the bullnose tip 406.

In other embodiments, however, the piston 806 may be operatively coupled to the sleeve member 804 using any other device or coupling method known to those skilled in the art. For example, in at least one embodiment, the piston 806 and the sleeve member 804 may be operatively coupled together using magnets (not shown). In such embodiments, one magnet may be installed in the piston 806 and a corresponding magnet may be installed in the sleeve member 804. The magnetic attraction between the two magnets may be such that movement of one urges or otherwise causes corresponding movement of the other.

FIG. 8A depicts the bullnose assembly 802 in a default configuration, and FIG. 8B depicts the bullnose assembly 802 in an actuated configuration. In the default configuration, the bullnose tip 406 and the sleeve member 804 are arranged generally adjacent each other such that the bullnose tip 406 effectively exhibits a first length 814*a* that incorporates the axial lengths of both the bullnose tip 406 and the sleeve member 804. The first length 814*a* is less than the distance 202 (FIG. 2) between the upper and lower deflectors 110*a,b* of the first and second deflector assemblies 100*a,b*.

In the actuated configuration shown in FIG. 8B, the sleeve member 804 is moved distally from the bullnose tip 406 such that the bullnose tip 406 effectively exhibits a second length 814*b* that encompasses the axial lengths of both the bullnose tip 406 and the sleeve member 804 and the axial distance between the two. The second length is greater than the first length 814*a*, and is also greater than the distance 202 (FIG. 2) between the upper and lower deflectors 110*a,b* of the first and second deflector assemblies 100*a,b*.

In order to move the bullnose assembly 802 from its default configuration (FIG. 8A) into its actuated configuration (FIG. 8B), the sleeve member 804 may be actuated. In some embodiments, actuating the sleeve member 804 involves applying hydraulic pressure to the bullnose assembly 802. More particularly, a hydraulic fluid 816 may be applied from a surface location, through the conveyance (i.e., coiled tubing, drill pipe, production tubing, etc.) coupled to the bullnose assembly 802, and from the conveyance to the interior of the bullnose assembly 802. At the bullnose assembly 802, the hydraulic fluid 816 enters the body 404 via a hydraulic conduit 818 which fluidly communicates with the hydraulic chamber 808 via a piston conduit 820 defined through the piston 806. Once the hydraulic fluid 816 enters the hydraulic chamber 808, it is able to act on the piston 806 such that it moves proximally (i.e., to the left in FIGS. 8A and 8B and otherwise toward the surface of the well) within the hydraulic chamber 808. One or more sealing elements 822, such as O-rings or the like, may be arranged between the piston 806 and the inner surface of the hydraulic chamber 808, and between the piston 806 and the outer surface of the hydraulic conduit 818, such that sealed engagements at each location result.

As the piston 806 moves axially out of the hydraulic chamber 808, the sleeve member 804 correspondingly moves axially since it is operatively coupled thereto. In the illustrated embodiment, as the piston 806 moves, the coupling pins 810 translate axially within the longitudinal grooves 812 and thereby move the sleeve member 804 in the same direction. Moreover, as the piston 806 moves, it engages a biasing device 824 arranged within a piston chamber 826 and compresses the biasing device 824 such that a spring force is generated therein. In some embodiments, the biasing device 824 may be a helical spring or the like. In other embodiments, the biasing device 824 may be a series of Belleville washers, an air shock, or the like, without departing from the scope of the disclosure.

Once it is desired to return the bullnose assembly 802 to its default configuration, the hydraulic pressure on the bullnose assembly 802 may be released. Upon releasing the hydraulic pressure, the spring force built up in the biasing device 824 may serve to force the piston 806 (and therefore the sleeve member 804) back to its default position, as shown in FIG. 8A, and thereby effectively return the bullnose tip 406 to the first length 814*a*. As will be appreciated, such an embodiment allows a well operator to increase the overall length of the bullnose assembly 802 on demand while downhole simply by applying pressure through the conveyance and to the bullnose assembly 802.

Those skilled in the art will readily recognize that several other methods may equally be used to actuate the sleeve member 804, and thereby move the bullnose assembly 802 between the default configuration (FIG. 8A) and the actuated configuration (FIG. 8B). For instance, although not depicted herein, the present disclosure also contemplates using one or more actuating devices to physically adjust the axial position of the sleeve member 804 and thereby lengthen the bullnose assembly 802. Such actuating devices may include, but are not limited to, mechanical actuators, electromechanical actuators, hydraulic actuators, pneumatic actuators, combinations thereof, and the like. Such actuators may be powered by a downhole power unit or the like, or otherwise powered from the surface via a control line or an electrical line. The actuating device (not shown) may be operatively coupled to the sleeve member 804 and configured to move the sleeve member 804 axially between the first length 814*a* and the second length 814*b*.

In yet other embodiments, the present disclosure further contemplates actuating the sleeve member 804 by using fluid flow around the bullnose assembly 802. In such embodiments, one or more ports (not shown) may be defined through the bullnose tip 406 such that the hydraulic chamber 808 is placed in fluid communication with the fluids outside the bullnose assembly 802. A fluid restricting nozzle may be arranged in one or more of the ports such that a pressure drop is created across the bullnose assembly 802. Such a pressure drop may be configured to force the piston 806 toward the actuated configuration (FIG. 8B) and correspondingly move the sleeve member 804 in the same direction. In yet other embodiments, hydrostatic pressure may be applied across the bullnose assembly 802 to achieve the same end.

Figure 9A:
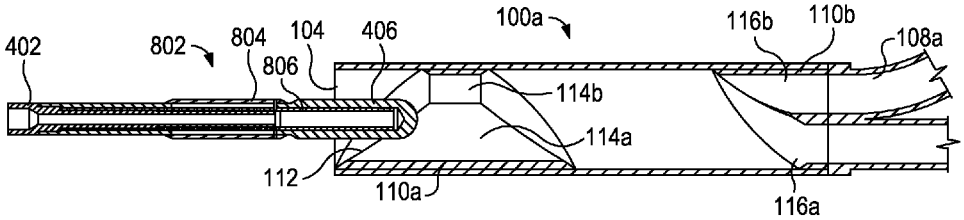
FIGS. 9A-9D illustrate progressive cross-sectional views of the bullnose assembly of FIGS. 8A and 8B used in exemplary operation, according to one or more embodiments.
Figure 9B:
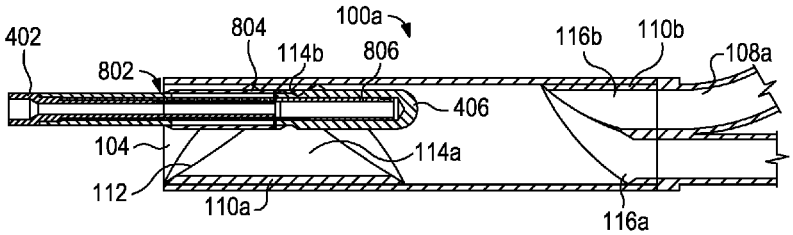
Figure 9C:
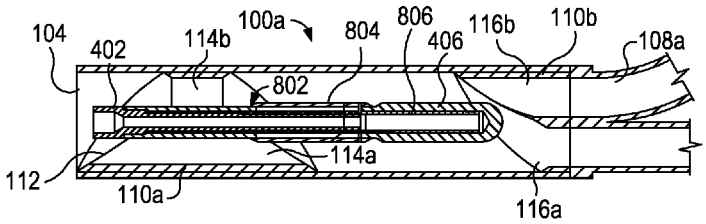
Figure 9D:
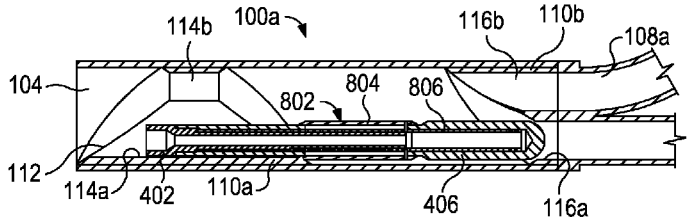
Figure 10A:
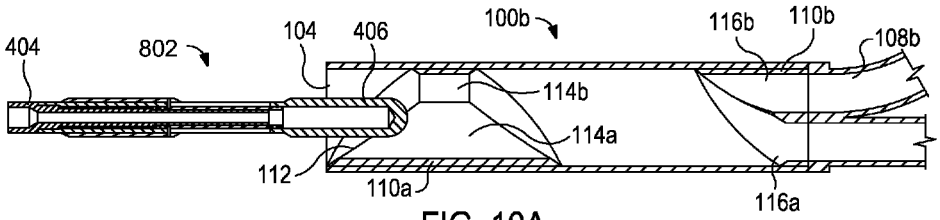
FIGS. 10A-10C illustrate progressive cross-sectional views of the bullnose assembly of FIGS. 8A and 8B used in additional exemplary operation, according to one or more embodiments.
Figure 10B:
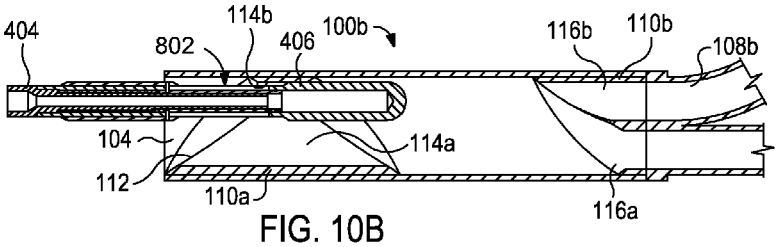
Figure 10C:
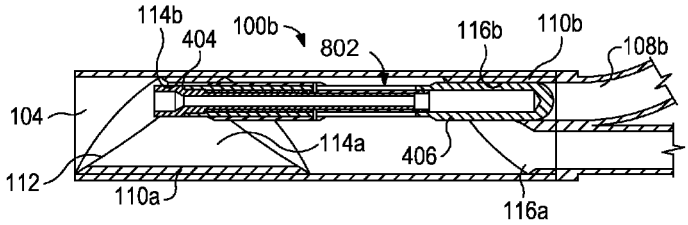

Referring now to FIGS. 9A-9D and FIGS. 10A-10C, with continued reference to the preceding figures, illustrated are cross-sectional side views of the variable-length bullnose assembly 802 of FIGS. 8A and 8B as used in exemplary operation, according to one or more embodiments. More particularly, FIGS. 9A-9D and 10A-10C are representative progressive views of the bullnose assembly 802 traversing the multilateral wellbore system 700 of FIG. 7, where FIGS. 9A-9D depict the bullnose assembly 802 in its default configuration at the first junction 106*a* (FIG. 7) and FIGS. 10A-10C depict the bullnose assembly 802 in its actuated configuration at the second junction 106*b* (FIG. 7).

Referring to FIGS. 9A-9D, illustrated are progressive views of the bullnose assembly 802 in its default configuration interacting with and otherwise being deflected by the first deflector assembly 100*a* at the first junction 106*a*. In FIG. 9A, the bullnose assembly 802 is shown engaging the upper deflector 110*a* after having been extended downhole within the main bore 104. The diameter 410*c* (FIG. 8A) of the bullnose tip 406 may be larger than the first width 302*a* (FIG. 3A) such that the bullnose tip 406 is unable to extend through the upper deflector 110*a* via the first channel 114*a*. Instead, the bullnose tip 406 may be configured to slidingly engage the ramped surface 112 until locating the second channel 114*b*. Since the diameter 410*c* (FIG. 8A) of the bullnose tip 406 is smaller than the second width 302*b* (FIG. 3A), the bullnose assembly 802 may be able to extend through the upper deflector 110*a* via the second channel 114*b*. This is shown in FIG. 9B as the bullnose assembly 802 is advanced in the main bore 104 and otherwise extended at least partially through the upper deflector 110*a*.

In FIG. 9C, the bullnose assembly 802 is advanced further in the main bore 104 until the bullnose tip 406 and the sleeve member 804 exit the second channel 114*b*. Upon the exit of the bullnose tip 406 and the sleeve member 804 from the second channel 114*b*, the bullnose assembly 802 may no longer be supported within the second channel 114*b* and may instead fall into or otherwise be received by the first channel 114*a*. This is possible since the diameter 412*c* (FIG. 9) of the body 404 of the bullnose assembly 802 is smaller than the first width 302*a* (FIG. 3A), and the length 814*a* (FIG. 8A) of the bullnose tip 406 in the default configuration is less than the distance 202 (FIG. 2) that separates the upper and lower deflectors 110*a,b*. Accordingly, gravity may act on the bullnose assembly 802 and allow it to fall into the first channel 114*a* once the bullnose tip 406 and the sleeve member 804 exit the second channel 114*b* and thereby no longer support the bullnose assembly 802.

In FIG. 9D, the bullnose assembly 802 is advanced even further in the main bore 104 until the bullnose tip 406 enters or is otherwise received within the first conduit 116*a*. The first conduit 116*a* exhibits a diameter 304*a* (FIG. 3B) that is greater than the diameter 410*c* (FIG. 8A) of the bullnose tip 406 and can therefore guide the bullnose assembly 802 further down the main bore 104 past the first junction 106*a* (FIG. 7) and otherwise not into the first lateral bore 108*a*.

Referring now to FIGS. 10A-10C, with continued reference to FIGS. 9A-9D, illustrated are cross-sectional side views of the second deflector assembly 100*b* as used in exemplary operation with the bullnose assembly 802 following passage through the first deflector assembly 100*a*. More particularly, FIGS. 10A-10C depict the bullnose assembly 802 after having passed through the first junction 106*a* in the multilateral wellbore system 700 of FIG. 7 and is now advanced further within the main bore 104 until interacting with and otherwise being deflected by the second deflector assembly 100*b* arranged at the second junction 106*b* (FIG. 7). Before the bullnose assembly 802 reaches the second junction 106*b*, however, the sleeve member 804 may be actuated, thereby moving the bullnose assembly 802 from its default configuration and into its actuated configuration as seen in FIGS. 10A-10C. In the actuated configuration, the bullnose assembly 802 may be configured to span the distance 202 (FIG. 2) between the upper and lower deflectors 110*a,b* and thereby enter the second lateral bore 108*b*.

In FIG. 10A, the bullnose assembly 802 is extended downhole in its actuated configuration within the main bore 104 and engages the upper deflector 110*a* of the second deflector assembly 100*b*. The diameter 410*c* (FIG. 8A) of the bullnose tip 406 may be larger than the first width 302*a* (FIG. 3A) such that the bullnose tip 406 is unable to extend through the upper deflector 110*a* via the first channel 114*a*. Instead, the bullnose tip 406 may be configured to slidingly engage the ramped surface 112 until locating the second channel 114*b*. Since the diameter 410*c* (FIG. 8A) of the bullnose tip 406 is smaller than the second width 302*b* (FIG. 3A), the bullnose assembly 802 is able to extend through the upper deflector 110*a* via the second channel 114*b*. This is shown in FIG. 10B as the bullnose assembly 802 is advanced in the main bore 104 and otherwise extended at least partially through the upper deflector 110*a*.

In FIG. 10C, the bullnose assembly 802 is advanced further in the main bore 104 and directed into the second conduit 116*b* of the lower deflector 110*b*. This is possible since the combined length 814*b* (FIG. 8B) of the bullnose tip 406 and the sleeve member 804 is greater than the distance 202 (FIG. 2) that separates the upper and lower deflectors 110*a,b* of the second deflector assembly 100*b*. In other words, since the distance 202 is less than the combined length 814*b* of the bullnose tip 406 and the sleeve member 804 in its actuated position, the bullnose assembly 802 is generally prevented from moving laterally within the main bore 104 and toward the first conduit 116*a* of the lower deflector 110*b*. Rather, the bullnose tip 406 is received by the second conduit 116*b* while at least a portion of the sleeve member 804 remains supported in the second channel 114*b* of the upper deflector 110*a*. Moreover, the second conduit 116*b* exhibits a diameter 304*b* (FIG. 3B) that is greater than the diameter 410*c* (FIG. 8A) of the bullnose tip 406 and can therefore guide the bullnose assembly 802 toward the second lateral bore 108*b*.

Once past the second junction 106*b* (FIG. 7) and into the second lateral bore 108*b* (FIG. 7), the sleeve member 804 may be actuated back to its default position. To accomplish this, in some embodiments, the hydraulic pressure within the bullnose assembly 802 may be released. In other embodiments, one or more actuating devices, as described above, may be configured to axially move the sleeve member 804 back to its default position.

If entry into the lower portions of the main bore 104 below the second junction 106*b* (FIG. 7) is desired, the bullnose assembly 802 may be pulled back up above the second junction 106*b* and then simply lowered back down in its default configuration and it will enter the main bore 104 below the second junction 106*b*. Again, this is possible since the combined length 814*a* (FIG. 8A) of the bullnose tip 406 and the sleeve member 804 in its default position is less than the distance 202 (FIG. 2) that separates the upper and lower deflectors 110*a,b* of the second deflector assembly 100*b*. Accordingly, the bullnose assembly 802 may be received into the first channel 114*a* once the bullnose tip 406 and the sleeve member 804 exit the second channel 114*b* and no longer support the bullnose assembly 802 therein.

Similarly, if entry is needed to the first lateral bore 108*a* (FIG. 7), the bullnose assembly 802 may be pulled back up above the first junction 106*a*, moved into its actuated configuration, and then lowered back downhole. In its actuated configuration, the bullnose assembly 802 may be advanced in the main bore 104 and will be directed into the second conduit 116*b* of the lower deflector 110*b* of the first deflector assembly 100*a*. Again, this is possible since the length 814*b* (FIG. 8B) of the bullnose tip 406 and the sleeve member 804 in its actuated position is greater than the distance 202 (FIG. 2) that separates the upper and lower deflectors 110*a,b*. As a result, the bullnose tip 406 is received by the second conduit 116*b* while at least a portion of the sleeve member 804 remains supported in the second channel 114*b*, thereby directing the bullnose assembly 802 toward the first lateral bore 108*a*.

Figure 11A:
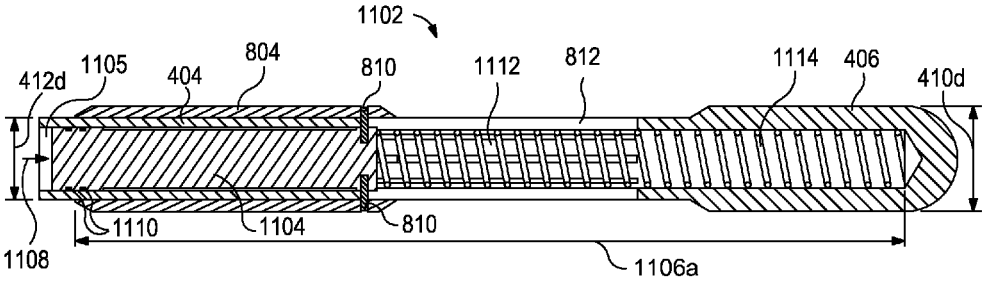
FIGS. 11A and 11B illustrate cross-sectional side views of another exemplary bullnose assembly, according to one or more embodiments.
Figure 11B:
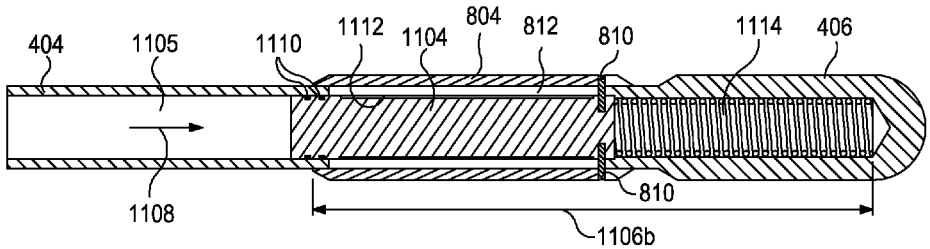

Referring now to FIGS. 11A and 11B, with continued reference to FIGS. 1 and 2, illustrated are cross-sectional side views of another exemplary bullnose assembly 1102 capable of adjusting its length, according to one or more embodiments. The bullnose assembly 1102 may be similar in some respects to the bullnose assemblies 402*a,b* and 802 of FIGS. 4A-B and 8A-B, respectively, and therefore will be best understood with reference thereto, where like numerals represent like elements not described again in detail. Similar to the bullnose assemblies 402*a,b* and 802, the bullnose assembly 1102 includes a body 404 and a bullnose tip 406 coupled to the distal end of the body 404 or otherwise forming an integral part thereof.

The bullnose tip 406 of the bullnose assembly 1102 exhibits a seventh diameter 410*d* that may be the same as or different than the first, second, and fifth diameters 410*a-c* (FIGS. 4A and 4B and FIG. 8A). In any event, the seventh diameter 410*c* may be small enough and otherwise able to extend through the second width 302*b* (FIG. 3A) of the upper deflector 110*a* and the first and second diameters 304*a,b* (FIG. 3B) of the lower deflector 110*b* of the deflector assembly 100 (FIGS. 1 and 2).

The body 404 of the bullnose assembly 1102 exhibits an eighth diameter 412*d* that may be the same as or different from the third, fourth, and sixth diameters 412*a-c* (FIGS. 4A and 4B and FIG. 8A). In any event, the eighth diameter 412*d* may be smaller than the first, second, third, and fifth diameters 410*a-d* and also smaller than the first width 302*a* (FIG. 3A) of the upper deflector 110*a* of the deflector assembly 100 (FIGS. 1 and 2), and otherwise able to be received therein.

The bullnose assembly 1102 may further include the sleeve member 804, as generally described above with reference to FIGS. 8A and 8B. A piston 1104 may be movably arranged within a hydraulic cavity 1105 defined within the body 404. The piston 1104 may be operatively coupled to the sleeve member 804 such that movement of the piston 1104 correspondingly moves the sleeve member 804. In the illustrated embodiment, one or more coupling pins 810 (two shown), as generally described above, may operatively couple the piston 1104 to the sleeve member 804 and extend between the piston 1104 and the sleeve member 804 through the corresponding longitudinal grooves 812. In other embodiments, however, the piston 1104 may be operatively coupled to the sleeve member 804 using other devices or coupling methods, such as magnets, as described above.

FIG. 11A depicts the bullnose assembly 1102 in a default configuration, and FIG. 11B depicts the bullnose assembly 1102 in an actuated configuration. In the default configuration, the sleeve member 804 is arranged distally from the bullnose tip 406 such that the bullnose tip 406 effectively exhibits a first length 1106*a* that is greater than the distance 202 (FIG. 2) between the upper and lower deflectors 110*a,b* of the deflector assembly 100 (FIGS. 1 and 2). In the actuated configuration, the sleeve member 804 is moved generally adjacent the bullnose tip 406 such that the bullnose tip 406 effectively exhibits a second length 1106*b* that incorporates the axial lengths of both the bullnose tip 406 and the sleeve member 804. The second length 1106*b* is less than the first length 1106*a* and also less than the distance 202 (FIG. 2) between the upper and lower deflectors 110*a,b* of the deflector assembly 100.

In order to move the bullnose assembly 1102 from its default configuration (FIG. 11A) into its actuated configuration (FIG. 11B), the sleeve member 804 may be actuated. In some embodiments, actuating the sleeve member 804 involves applying hydraulic pressure to the bullnose assembly 1102. More particularly, a hydraulic fluid 1108 may be applied from a surface location, through the conveyance (i.e., coiled tubing, drill pipe, production tubing, etc.) coupled to the bullnose assembly 1102, and from the conveyance to the interior of the bullnose assembly 1102. At the bullnose assembly 1102, the hydraulic fluid 1108 enters the body 404 via the hydraulic cavity 1105 and acts on the end of the piston 1104. One or more sealing elements 1110 (two shown), such as O-rings or the like, may be arranged between the piston 1104 and the inner surface of the hydraulic cavity 1105 such that sealed engagements at each location result.

The hydraulic fluid 1108 acts on the piston 1104 such that it moves distally (i.e., to the right in FIGS. 11A and 11B) within the hydraulic cavity 1105 and into a piston chamber 1112 defined within the bullnose tip 406. In some embodiments, the hydraulic cavity 1105 and the piston chamber 1112 may be the same and the piston 1104 translates axially therein. As the piston 1104 moves axially into the piston chamber 1112, the sleeve member 804 correspondingly moves axially since it is operatively coupled thereto. In the illustrated embodiment, as the piston 1104 moves, the coupling pins 810 translate axially within the longitudinal grooves 812 and thereby move the sleeve member 804 in the same direction. Moreover, as the piston 1104 moves, it engages a biasing device 1114 arranged within the piston chamber 1112 and compresses the biasing device 1114 such that a spring force is generated therein. Similar to the biasing device 824, the biasing device 1114 may be a helical spring, a series of Belleville washers, an air shock, or the like.

Once it is desired to return the bullnose assembly 1102 to its default configuration, the hydraulic pressure on the bullnose assembly 1102 may be released. Upon releasing the hydraulic pressure, the spring force built up in the biasing device 1114 may serve to force the piston 1104 (and therefore the sleeve member 804) back to the default position shown in FIG. 11A, and thereby effectively return the bullnose tip 406 to the first length 1106*a*. As will be appreciated, such an embodiment allows a well operator to decrease the overall length of the bullnose assembly 1102 on demand while downhole simply by applying pressure through the conveyance and to the bullnose assembly 1102.

Similar to the bullnose assembly 802 of FIGS. 8A and 8B, several other methods may equally be used to actuate the sleeve member 804, and thereby move the bullnose assembly 1102 between the default configuration (FIG. 11A) and the actuated configuration (FIG. 11A). For instance, the present disclosure also contemplates using one or more actuating devices to physically adjust the axial position of the sleeve member 804 and thereby decrease the effective axial length 1106*b* of the bullnose tip 406. The actuating device (not shown) may be operatively coupled to the sleeve member 804 and configured to move the sleeve member 804 axially between the first length 1106*a* and the second length 1106*b*. In other embodiments, the present disclosure further contemplates actuating the sleeve member 804 using fluid flow around the bullnose assembly 1102 or hydrostatic pressure, as generally described above.

Accordingly, upon being actuated, as described above, the sleeve member 804 may be configured to move axially with respect to the bullnose tip 406, and thereby effectively decrease the effective overall length of the bullnose tip 406. In exemplary operation using the bullnose assembly 1102, the sleeve member 804 would remain in the actuated position until it is desired to enter a lateral bore 108 (FIGS. 1 and 2). In the actuated configuration, the bullnose assembly 1102 would effectively exhibit the second length 1106*b*, and therefore be unable to enter a lateral bore 108 (FIGS. 1 and 2) since the second length 1106*b* is shorter than the distance 202 (FIGS. 1 and 2) between the upper and lower deflectors 110*a,b* of the deflector assembly 100.

When it is desired to enter a lateral bore 108, the bullnose assembly 1102 may be returned to its default position, thereby providing the bullnose assembly 1102 with the first length 1106*a*. Since the first length 1106*a* is greater than the distance 202 (FIGS. 1 and 2) between the upper and lower deflectors 110*a,b* of the deflector assembly 100, the bullnose tip 806 would be directed into the second conduit 116*b* of the lower deflector 110*b* and thereby guided into the lateral bore 108. As will be appreciated, similar to the bullnose assembly 802 of FIGS. 8A and 8B, the bullnose assembly 1102 may be used in the multilateral wellbore system 700 of FIG. 7 in order to access any of the lateral bores 108*a-c* by adjusting its axial length, as described above.

The present disclosure also contemplates varying the length of the bullnose assemblies 802, 1102 generally described herein using a movable bullnose tip 406 instead of a movable sleeve member 804. More particularly, in some embodiments, the sleeve member 804 may be a stationary part or portion of the bullnose assembly 802, 1102 and instead the axial position of the bullnose tip 406 may be adjusted with respect to the sleeve member 804 in order to move between the default and actuated configurations described above. Accordingly, in such embodiments, actuating the bullnose assembly 802 of FIGS. 8A and 8B would serve to move the bullnose tip 406 with respect to the sleeve member 804 from the first length 814*a* to the second length 814*b*. Similarly, actuating the bullnose assembly 1102 of FIGS. 11A and 11B would serve to move the bullnose tip 406 with respect to the sleeve member 804 from the first length 1106*a* to the second length 1106*b*.

As will be appreciated, similar actuating means may be employed in order to move the bullnose tip 406 with respect to the sleeve member 804. Such means include, but not are limited to, using hydraulic pressure acting on a piston operatively coupled to the bullnose tip 406, an actuating device operatively coupled to the bullnose tip 406, and a pressure drop created across the bullnose assembly 802, 1102 which forces a piston that is operatively coupled to the bullnose tip 406 to move.

Embodiments disclosed herein include:

A. A wellbore system that includes an upper deflector arranged within a main bore of a wellbore and defining first and second channels that extend longitudinally through the upper deflector, a lower deflector arranged within the main bore and spaced from the upper deflector by a predetermined distance, the lower deflector defining a first conduit that communicates with a lower portion of the main bore and a second conduit that communicates with a lateral bore, and a bullnose assembly including a body, a bullnose tip arranged at a distal end of the body, and a sleeve member arranged about the body, wherein one of the bullnose tip and the sleeve member is axially movable in order to vary a length of the bullnose tip, wherein the upper and lower deflectors are configured to direct the bullnose assembly into either the lateral bore or the lower portion of the main bore based on the length of the bullnose tip as compared to the predetermined distance.

B. A method that includes introducing a bullnose assembly into a main bore of a wellbore, the bullnose assembly including a body, a bullnose tip arranged at a distal end of the body, and a sleeve member arranged about the body, wherein at least one of the bullnose tip and the sleeve member is axially movable in order to vary a length of the bullnose tip, directing the bullnose assembly through an upper deflector arranged within the main bore, the upper deflector defining first and second channels that extend longitudinally therethrough, advancing the bullnose assembly to a lower deflector arranged within the main bore and spaced from the upper deflector by a predetermined distance, the lower deflector defining a first conduit that communicates with a lower portion of the main bore and a second conduit that communicates with a lateral bore, and directing the bullnose assembly into either the lateral bore or the lower portion of the main bore based on the length of the bullnose tip as compared to the predetermined distance.

C. A multilateral wellbore system that includes a main bore having a first junction and a second junction spaced downhole from the first junction, a first deflector assembly arranged at the first junction and comprising a first upper deflector and a first lower deflector spaced from the first upper deflector by a predetermined distance, the first lower deflector defining a first conduit that communicates with a first lower portion of the main bore and a second conduit that communicates with a first lateral bore, a second deflector assembly arranged at the second junction and comprising a second upper deflector and a second lower deflector spaced from the second upper deflector by the predetermined distance, the second lower deflector defining a third conduit that communicates with a second lower portion of the main bore and a fourth conduit that communicates with a second lateral bore, and a bullnose assembly including a body, a bullnose tip arranged at a distal end of the body, and a sleeve member arranged about the body, wherein one of the bullnose tip and the sleeve member is axially movable in order to vary a length of the bullnose tip, wherein the first and second deflector assemblies are configured to direct the bullnose assembly into either the first and second lateral bores or the first and second lower portions of the main bore based on the length of the bullnose tip as compared to the predetermined distance.

Each of embodiments A, B, and C may have one or more of the following additional elements in any combination: Element 1: wherein the upper deflector provides a ramped surface facing toward an uphole direction within the main bore, the ramped surface being configured to direct the bullnose assembly into the second channel. Element 2: wherein, when the length of the bullnose tip is greater than the predetermined distance, the bullnose assembly is directed into the second conduit and the lateral bore. Element 3: wherein, when the length of the bullnose tip is less than the predetermined distance, the bullnose assembly is directed into the first conduit and the lower portion of the main bore. Element 4: wherein the bullnose tip or the sleeve member is actuatable between a default configuration, where the length of the bullnose tip exhibits a first length, and an actuated configuration, where the length of the bullnose tip exhibits a second length. Element 5: wherein the first length is less than the predetermined distance, and the second length is greater than both the first length and the predetermined distance. Element 6: wherein the first length is greater than both the second length and the predetermined distance, and the second length is less than the predetermined distance. Element 7: wherein the bullnose tip or the sleeve member is actuatable using at least one of hydraulic pressure acting on a piston operatively coupled to one of the bullnose tip or the sleeve member, an actuating device operatively coupled to one of the bullnose tip or the sleeve member, and a pressure drop created across the bullnose assembly which forces a piston that is operatively coupled to one of the bullnose tip or the sleeve member to move.

Element 8: wherein directing the bullnose assembly through the upper deflector includes engaging the bullnose tip on a ramped surface defined by the upper deflector, and directing the bullnose tip into and through the second channel with the ramped surface. Element 9: further comprising actuating the bullnose assembly between a default configuration, where the length of the bullnose tip exhibits a first length that is less than the predetermined distance, and an actuated configuration, where the length of the bullnose tip exhibits a second length that is greater than both the first length and the predetermined distance. Element 10: further comprising directing the bullnose assembly into the first conduit and the lower portion of the main bore when the length of the bullnose tip is the first length, and directing the bullnose assembly into the second conduit and the lateral bore when the length of the bullnose tip is the second length. Element 11: further comprising actuating the bullnose assembly between a default configuration, where the length of the bullnose tip exhibits a first length, and an actuated configuration, where the length of the bullnose tip exhibits a second length, wherein the second length is less than the predetermined distance and the first length is greater than both the second length and the predetermined distance. Element 12: further including directing the bullnose assembly into the second conduit and the lateral bore when the length of the bullnose tip is the first length, and directing the bullnose assembly into the first conduit and the lower portion of the main bore when the length of the bullnose tip is the second length. Element 13: further comprising actuating the bullnose assembly by using at least one of hydraulic pressure acting on a piston operatively coupled to one of the bullnose tip or the sleeve member, an actuating device operatively coupled to one of the bullnose tip or the sleeve member, and a pressure drop created across the bullnose assembly which forces a piston that is operatively coupled to one of the bullnose tip or the sleeve member to move.

Element 14: wherein, when the length of the bullnose tip is the first length, the bullnose assembly is directed into the first conduit and the first lower portion of the main bore or the third conduit and the second lower portion of the main bore, and wherein when the length of the bullnose tip is the second length, the bullnose assembly is directed into the second conduit and the first lateral bore or the fourth conduit and the second lateral bore. Element 15: wherein, when the length of the bullnose tip is the first length, the bullnose assembly is directed into the second conduit and the first lateral bore or the fourth conduit and the second lateral bore, and wherein, when the length of the bullnose tip is the second length, the bullnose assembly is directed into the first conduit and the first lower portion of the main bore or the third conduit and the second lower portion of the main bore.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A wellbore system, comprising:

an upper deflector arranged within a main bore of a wellbore and defining first and second channels that extend longitudinally through the upper deflector;

a lower deflector arranged within the main bore and spaced from the upper deflector by a predetermined distance, the lower deflector defining a first conduit that extends longitudinally through the lower deflector and communicates with a lower portion of the main bore and a second conduit that extends longitudinally through the lower deflector and communicates with a lateral bore; and a bullnose assembly including a body, a bullnose tip arranged at a distal end of the body, and a sleeve member arranged about the body, wherein one of the bullnose tip and the sleeve member is axially movable to vary a length of the bullnose tip, wherein the upper and lower deflectors direct the bullnose assembly through the second conduit and into the lateral bore or through the first conduit and into the lower portion of the main bore based on the length of the bullnose tip as compared to the predetermined distance.

2. The wellbore system of claim 1, wherein the upper deflector provides a ramped surface facing toward an uphole direction within the main bore, the ramped surface being configured to direct the bullnose assembly into the second channel.

3. The wellbore system of claim 1, wherein the bullnose assembly is directed into the second conduit and the lateral bore with the length of the bullnose tip being greater than the predetermined distance.

4. The wellbore system of claim 1, wherein the bullnose assembly is directed into the first conduit and the lower portion of the main bore with the length of the bullnose tip being less than the predetermined distance.

5. The wellbore system of claim 1, wherein the bullnose tip or the sleeve member is actuatable between a default configuration, where the length of the bullnose tip exhibits a first length, and an actuated configuration, where the length of the bullnose tip exhibits a second length.

6. The wellbore system of claim 5, wherein the first length is less than the predetermined distance, and the second length is greater than both the first length and the predetermined distance.

7. The wellbore system of claim 5, wherein the first length is greater than both the second length and the predetermined distance, and the second length is less than the predetermined distance.

8. The wellbore system of claim 1, wherein the bullnose tip or the sleeve member is actuatable using at least one of hydraulic pressure acting on a piston operatively coupled to one of the bullnose tip or the sleeve member, an actuating device operatively coupled to one of the bullnose tip or the sleeve member, and a pressure drop created across the bullnose assembly which forces a piston that is operatively coupled to one of the bullnose tip or the sleeve member to move.

9. A method, comprising:

introducing a bullnose assembly into a main bore of a wellbore, the bullnose assembly including a body, a bullnose tip arranged at a distal end of the body, and a sleeve member arranged about the body, wherein at least one of the bullnose tip and the sleeve member is axially movable in order to vary a length of the bullnose tip;

directing the bullnose assembly through an upper deflector arranged within the main bore, the upper deflector defining first and second channels that extend longitudinally therethrough;

advancing the bullnose assembly to a lower deflector arranged within the main bore and spaced from the upper deflector by a predetermined distance, the lower deflector defining a first conduit that communicates with a lower portion of the main bore and a second conduit that communicates with a lateral bore; and directing the bullnose assembly into either the lateral bore or the lower portion of the main bore based on the length of the bullnose tip as compared to the predetermined distance.

10. The method of claim 9, wherein directing the bullnose assembly through the upper deflector comprises:

engaging the bullnose tip on a ramped surface defined by the upper deflector; and directing the bullnose tip into and through the second channel with the ramped surface.

11. The method of claim 9, further comprising actuating the bullnose assembly between a default configuration, where the length of the bullnose tip exhibits a first length that is less than the predetermined distance, and an actuated configuration, where the length of the bullnose tip exhibits a second length that is greater than both the first length and the predetermined distance.

12. The method of claim 11, further comprising:

directing the bullnose assembly into the first conduit and the lower portion of the main bore with the bullnose tip in the default configuration; and directing the bullnose assembly into the second conduit and the lateral bore with the bullnose tip in the actuated configuration.

13. The method of claim 9, further comprising actuating the bullnose assembly between a default configuration, where the length of the bullnose tip exhibits a first length, and an actuated configuration, where the length of the bullnose tip exhibits a second length, wherein the second length is less than the predetermined distance and the first length is greater than both the second length and the predetermined distance.

14. The method of claim 13, further comprising:

directing the bullnose assembly into the second conduit and the lateral bore with the bullnose tip in the default configuration; and directing the bullnose assembly into the first conduit and the lower portion of the main bore with the bullnose tip in the actuated configuration.

15. The method of claim 9, further comprising actuating the bullnose assembly by using at least one of hydraulic pressure acting on a piston operatively coupled to one of the bullnose tip or the sleeve member, an actuating device operatively coupled to one of the bullnose tip or the sleeve member, and a pressure drop created across the bullnose assembly which forces a piston that is operatively coupled to one of the bullnose tip or the sleeve member to move.

16. A multilateral wellbore system, comprising:

a main bore having a first junction and a second junction spaced downhole from the first junction;

a first deflector assembly arranged at the first junction and comprising a first upper deflector and a first lower deflector spaced from the first upper deflector by a predetermined distance, the first lower deflector defining a first conduit that extends longitudinally through the first lower deflector and communicates with a first lower portion of the main bore and a second conduit that extends longitudinally through the first lower deflector and communicates with a first lateral bore;

a second deflector assembly arranged at the second junction and comprising a second upper deflector and a second lower deflector spaced from the second upper deflector by the predetermined distance, the second lower deflector defining a third conduit that extends longitudinally through the second lower deflector and communicates with a second lower portion of the main bore and a fourth conduit that extends longitudinally through the second lower deflector and communicates with a second lateral bore; and a bullnose assembly including a body, a bullnose tip arranged at a distal end of the body, and a sleeve member arranged about the body, wherein one of the bullnose tip and the sleeve member is axially movable in order to vary a length of the bullnose tip, wherein the first and second deflector assemblies direct the bullnose assembly through the second and fourth conduits and into the first and second lateral bores, respectively, or through the first and third conduits and into the first and second lower portions, respectively, of the main bore based on the length of the bullnose tip as compared to the predetermined distance.

17. The multilateral wellbore system of claim 16, wherein the bullnose assembly is actuatable between a default configuration, where the length of the bullnose tip exhibits a first length that is less than the predetermined distance, and an actuated configuration, where the length of the bullnose tip exhibits a second length that is greater than both the first length and the predetermined distance.

18. The multilateral wellbore system of claim 17, wherein, with the length of the bullnose tip at the first length, the bullnose assembly is directed into the first conduit and the first lower portion of the main bore or the third conduit and the second lower portion of the main bore, and wherein, with the length of the bullnose tip at the second length, the bullnose assembly is directed into the second conduit and the first lateral bore or the fourth conduit and the second lateral bore.

19. The multilateral wellbore system of claim 16, wherein the bullnose assembly is actuatable between a default configuration, where the length of the bullnose tip exhibits a first length, and an actuated configuration, where the length of the bullnose tip exhibits a second length, wherein the second length is less than the predetermined distance, and the first length is greater than both the second length and the predetermined distance.

20. The multilateral wellbore system of claim 19, wherein, with the length of the bullnose tip at the first length, the bullnose assembly is directed into the second conduit and the first lateral bore or the fourth conduit and the second lateral bore; and wherein, with the length of the bullnose tip at the second length, the bullnose assembly is directed into the first conduit and the first lower portion of the main bore or the third conduit and the second lower portion of the main bore.

21. The multilateral wellbore system of claim 16, wherein the bullnose assembly is actuatable using at least one of hydraulic pressure acting on a piston operatively coupled to one of the bullnose tip or the sleeve member, an actuating device operatively coupled to one of the bullnose tip or the sleeve member, and a pressure drop created across the bullnose assembly which forces a piston that is operatively coupled to one of the bullnose tip or the sleeve member to move.

* * * * *